US005321997A

United States Patent [19]

Carty

[11] Patent Number: 5,321,997

[45] Date of Patent: Jun. 21, 1994

[54] VICISTUBE F-96 TUBE CHANGER

[76] Inventor: James E. Carty, Rte. 1, Box 1, Coleman, Ga. 31736

[21] Appl. No.: 913,647

[22] Filed: Aug. 20, 1992

[51] Int. Cl.[5] ..... B25B 23/16

[52] U.S. Cl. ..... 81/53.1; 294/111

[58] Field of Search ..... 81/53.1; 294/22, 106, 294/111, 117

[56] References Cited

U.S. PATENT DOCUMENTS 4,611,512 9/1986 Honda ..... 81/53.1

4,791,835 12/1988 Unger et al. ..... 81/53.1 X

FOREIGN PATENT DOCUMENTS 1566676 5/1980 United Kingdom ..... 81/53.1

*Primary Examiner*—James G. Smith

[57] ABSTRACT

A fluorescent tube can be installed or removed from a high installation position by a device have four firm, rubber like cups which gently grip the tube; a dual set of horizontal elongated crossbars, which support the cups with the front crossbar being non stationary and the back cross bar being stationary; a pair of alignment spacer bars and a center support assembly which aid in stability and maintain the proximity of the cross bars; a hand operated rope to apply pressure through a combination of two pulleys to initiate spring action for separating the cups allowing them to either grip or release the fluorescent tube.

2 Claims, 26 Drawing Sheets

VICISTUBE F-96 TUBE CHANGER

FIELD OF THE INVENTION

This invention relates to a device used for installing or removing fluorescent tubes safely and easily from open lighting fixtures which are located at elevated positions and beyond the reach of a person standing on floor level. Such fixtures used in stores, warehouses, workshops, and the like are only accessible manually by the use of a step ladder or by the use of power lift of the type commonly known as a cherry picker.

BACKGROUND OF INVENTION

The present invention relates to a device for installing or removing fluorescent tubes from open lighting fixtures.

I was employed in the retail merchandising field for over 35 years and have long seen the need for a safe, convenient means of changing fluorescent tubes from floor level. The necessity of the use of a heavy step ladder proved difficult and even dangerous to employees, merchandise, and customers in the area, thus employees were likely to postpone changing defective tubes. This meant employees and customers had to endure flickering lights or darken areas, as well as, the defective fluorescent tube possibly causing damage to the ballast which would incur more costly repairs.

When I invented my device, I had only seen changers which used basket type enclosures to handle incandescent light bulbs. Since my patent application was first filed, I have become aware of the following:

U.S. Pat. No. 4,611,512

U.S. Pat. No. 4,791,835

U. K. Patent Number 1566 676

Fluorescent tubes commonly are provided with contact pins at their respective ends which must be properly positioned within spaced socket members carried by the lighting fixture. Fluorescent tubes with a single contact pin at each of its ends must be moved axially of their longitudinal axis against spring loaded contacts of the respective socket members in order to install or remove the fluorescent tube. Additionally, it is highly desirable that fluorescent tubes of this type be rotated prior to removal and subsequent to installation as there is a tendency of the pins to stick within the sockets due to the build up of oxidation and other debris in the socket.

Today most fluorescent lighting fixtures which utilize dual pin tubes are of the closed type, that is they have covers over the tubes. Since someone would have to reach the fixture to remove the cover, that person could replace the tube at the same time. I have therefore invented a device that can be used most effectively in changing single pin fluorescent tubes.

The most common problems encountered by previous devices have been:

1. The complicated mechanisms consisting of cradles, rollers, gears, belts, cylinders, and springs have neccitated the devices be heavy and difficult to handle.
2. While operating the complicated mechanisms only one hand was available to hold and balance the pole while the fluorescent tube is actually being inserted or removed from the lighting fixture.
3. Flew safety features were included in previous devices. Today industry is more aware of the advantages both psychologically and cost effectively of promoting safety features in all tasks.

SUMMARY OF THE INVENTION

My invention was made to overcome the problems encountered in the conventional devices for replacing fluorescent tubes as well as be economical, safe, and easily operated by a person of moderate strength.

To safely hold a fluorescent tube this device utilizes four rubber like cups which are attached to two horizontal cross bars whose elongated u-shape is effected by straight cross tubing being coupled at each extremity by 90 degree elbows to short vertical angles or arms. These cross bars are always of equal length, but the length may vary. At the center of the horizontal cross bars there is a center support assembly which is in turn attached to the pole.

Two alignment bar assemblies are situated between the extremities and the center of the cross bars to maintain their proximity and for stability. The back cross bar is held stationary by two braces which are attached at one end to approximately six inches of either side of the center of the cross tubing and at the other end to the center support assembly. The other or front cross bar is non stationary and its movement is controlled by an upper angle or arm which is attached at the center of the cross tubing. This upper angle or arm acts as a lever and it is operated by pressure exerted by a rope and pulley assembly.

The pulley assembly consists of a rope which goes through an upper pulley, down to a lower pulley, and then back up to be attached to the upper angle causing it to move the front horizontal cross bar forward when the rope is pulled.

The two rubber like cups attached to the front non stationary cross bar are confined by plates which has been shaped to hold the cups in a curved position. These shaper plates are attached to the vertical angles or arms immediately behind the cups.

The relationship of the elongated cross bars with the attached cups is regulated by two springs which are attached to the vertical arms immediately above the 90 degree elbows. These springs are partially covered by plastic tubing which protects the fluorescent tube should it slip and strike the springs while being handled. Each spring is in a normal, no tension position when the cups are closed or in a gripping position. This allows the operator to have the use of both hands while maneuvering to either remove or insert the tube. This spring assembly action is very important and unique to this device. Just a pull on the rope and the springs are extended allowing the non stationary horizontal cross bars to move and separate the cups thereby either releasing a held fluorescent tube or allowing device to grasp a fluorescent tube.

The stationary cross bar braces, the non stationary cross bar's support arm, and the pulley assembly are all affixed by means of a center support assembly which is attached to the pole which may be made of light weight metal alloy and may be telescopic. When the pole is made of metal alloy, a wooden section is inserted in the pole to prevent electrical charges from passing to the operator should the device come into contact with live electrical current.

The above description should not be construed as limiting the ways in which this invention may be practiced but shall be inclusive of many other variations that do not depart from the broad interest and interest of the invention. Other features and advantages of this invention will become more apparent when the following 'Best Mode of Carrying Out The Invention' is read in conjunction with the accompanying drawings.

BRIEF DESCRIPTION OF THE DRAWINGS

For a fuller understanding of the nature of this invention, reference should be made to the following detailed description, taken in connection with the accompanying drawing in which.

BEST MODE FOR CARRYING OUT THE INVENTION

This invention is a device for changing F-96 fluorescent tubes in open ceiling fixtures from floor level and the device is mounted on a pole which may be telescopic and may be made of light weight metal alloy. The pole is hand held and must be manipulated with a degree of dexterity in order to insert or remove a fluorescent tube in a lighting fixture.

Figure 1:
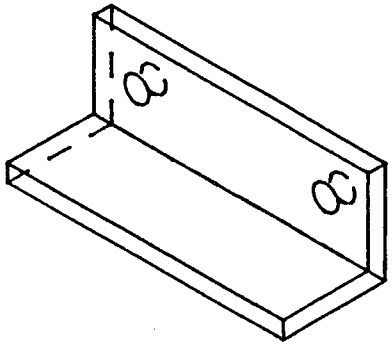
FIG. 1 is a side view of a simple angle used as a support brace.
Figure 2:
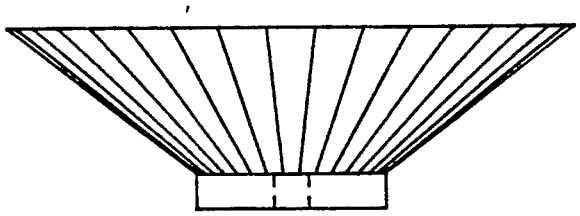
FIG. 2 is a side view of a suction cup used because it fits the need for a firm rubber like material that is flexible and able to grip the fluorescent tube.
Figure 3:
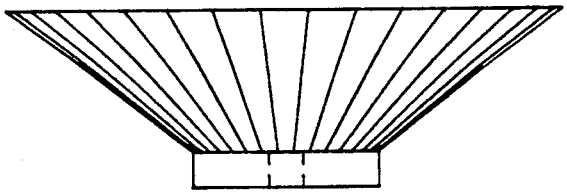
FIG. 3 is a side view of a suction cup used because it fits the need for a firm rubber like material that is flexible and able to grip the fluorescent tube.
Figure 4:
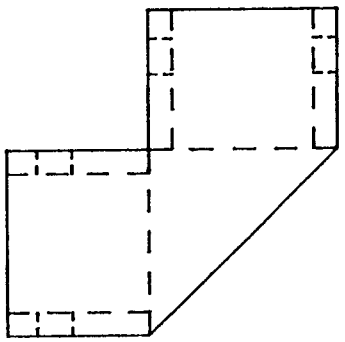
FIG. 4 is the side view of a 90 degree elbow which is used to connect the vertical tube which supports the rubber like cups to the horizontal cross tubing.
Figure 5:
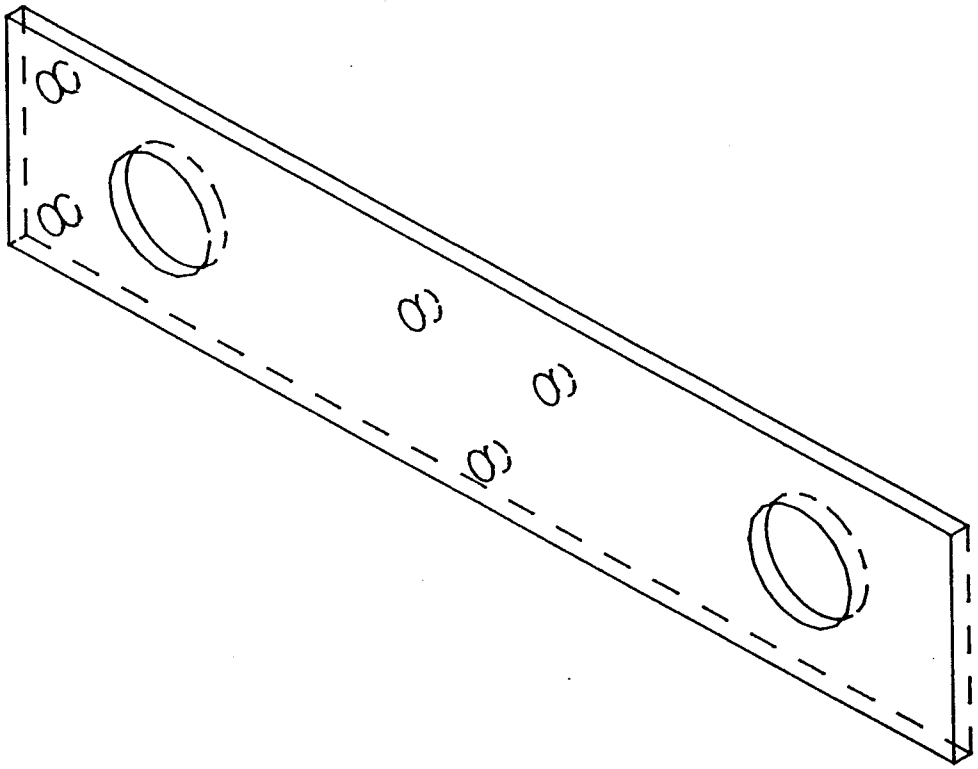
FIG. 5 is a side view of the center spacer bar.
Figure 6:
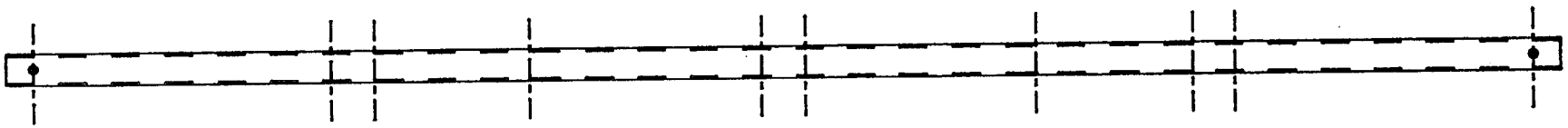
FIG. 6 is a side view of the horizontal cross tubing which is used in both the stationary and non stationary cross bars and both tubing are of equal length.
Figure 7:
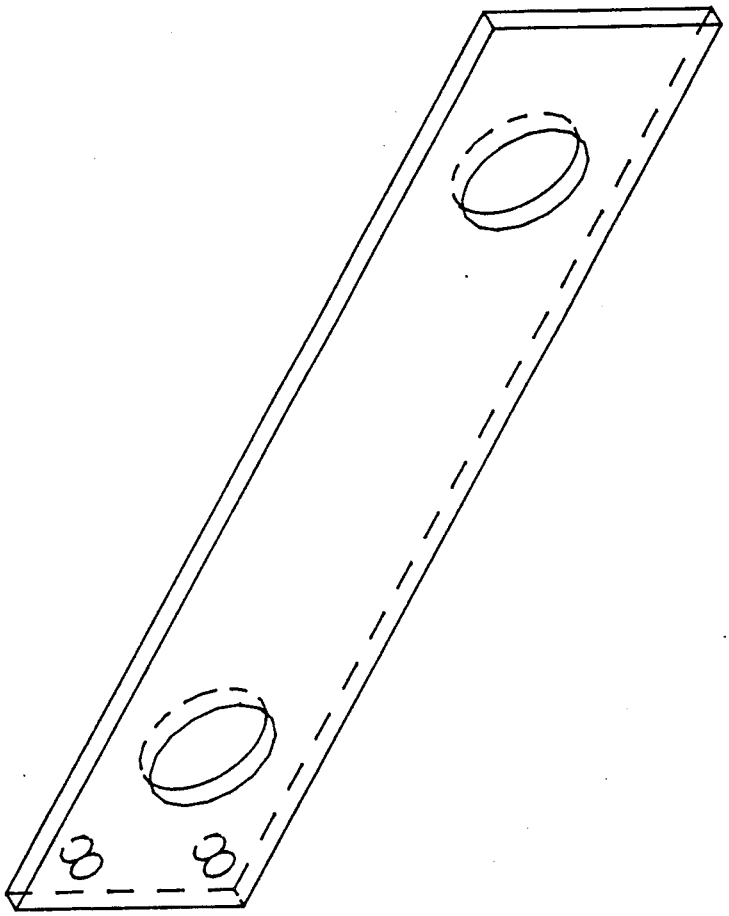
FIG. 7 is a side view of the horizontal tube alignment bar which is situated between the extremities and the center of the cross bars to maintain their proximity and for stability.
Figure 8:
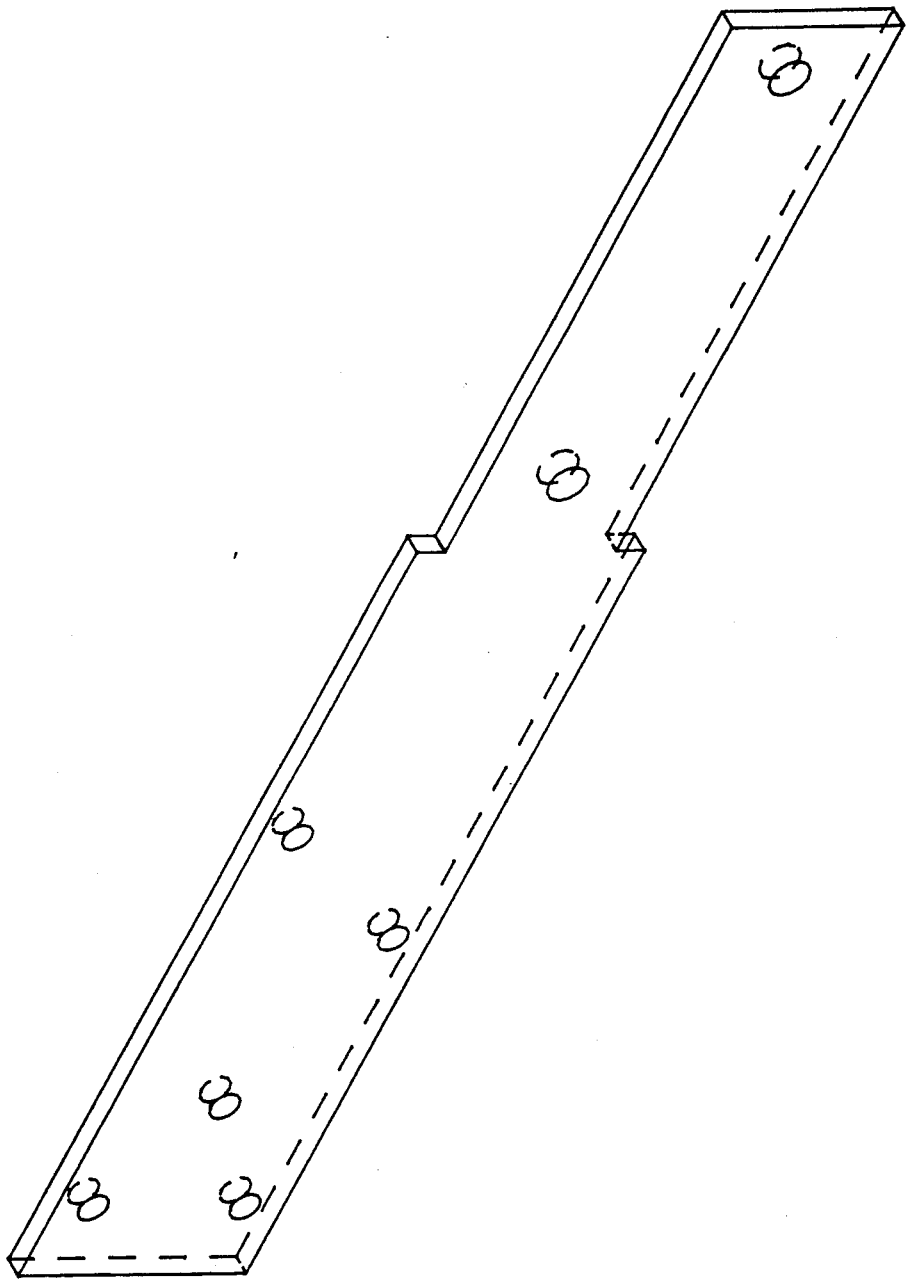
FIG. 8 is a side view of the main outer vertical center support.
Figure 9:
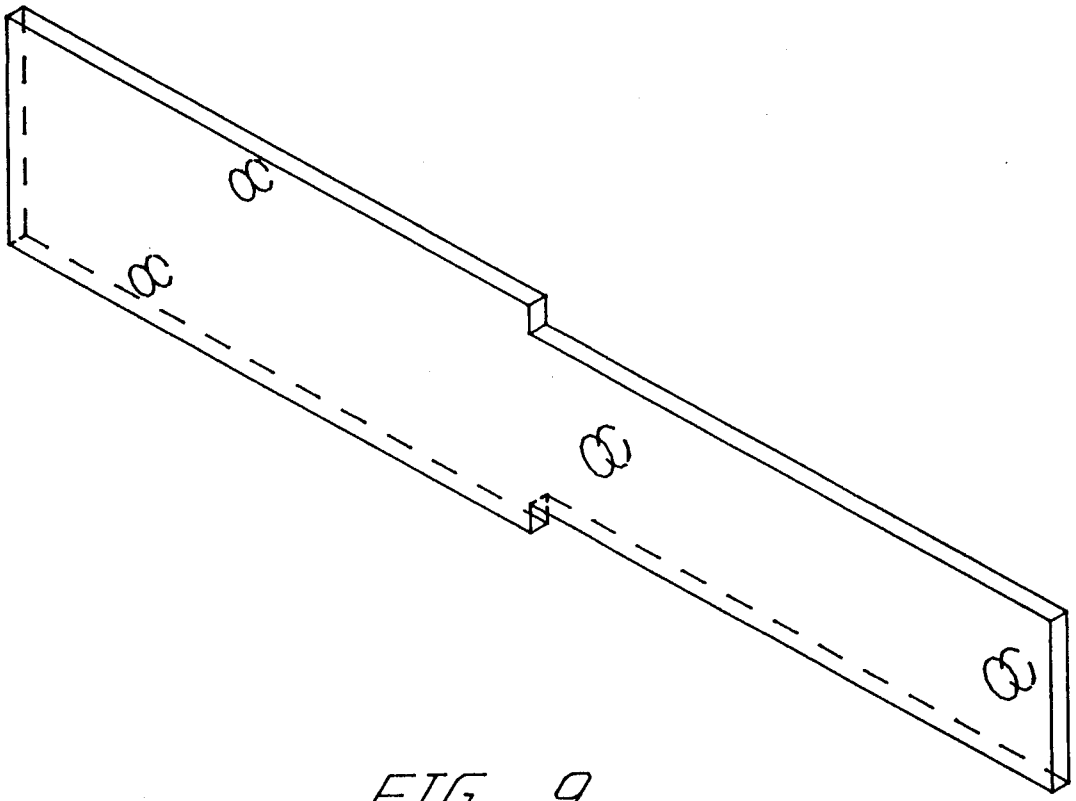
FIG. 9 is a side view of the main inner vertical center support.
Figure 10:
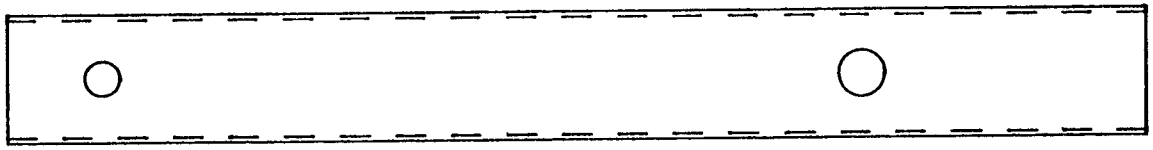
FIG. 10 is a side view of the vertical tube or arm which is used to support the rubber like cup and serves as the means where they are attached via 90 degree elbows to the cross tubing of the non stationary cross bar.
Figure 11:
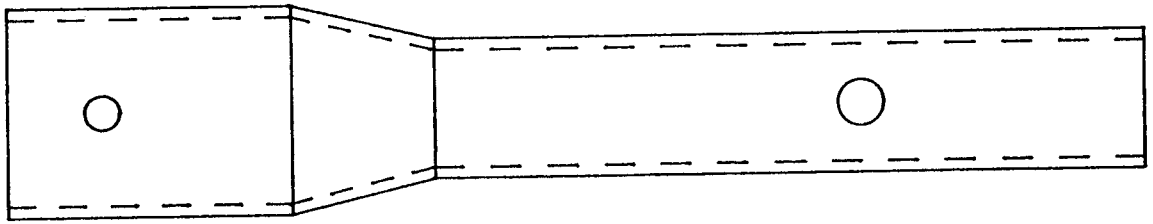
FIG. 11 is a side view of the vertical tube or arm, note it has been pressed flat on the end which is situated as the upper end when the opposing end is connected to the 90 degree elbow of the stationary cross bar.
Figure 12:
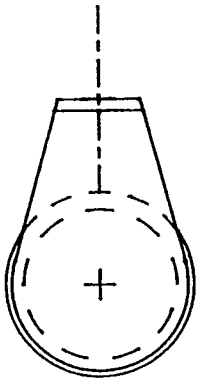
FIG. 12 is a side view of a simple pulley which is one of two used.
Figure 13:
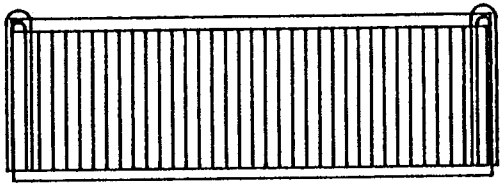
FIG. 13 is a side view of the spring which is one of two used.
Figure 14:
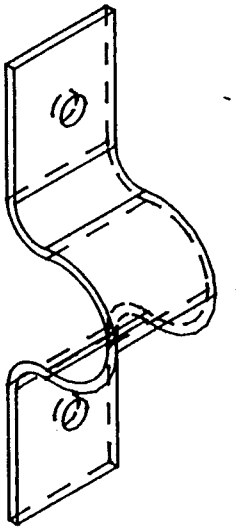
FIG. 14 is a side view of a clamp.
Figure 15:
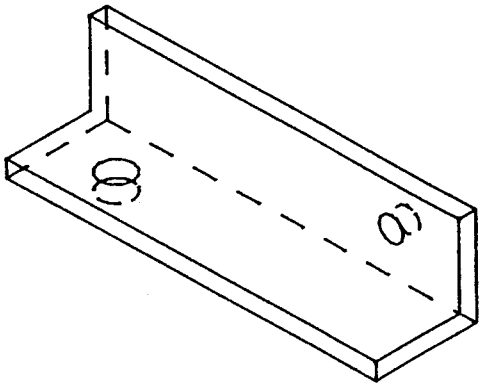
FIG. 15 is a side view of an angle.
Figure 16:
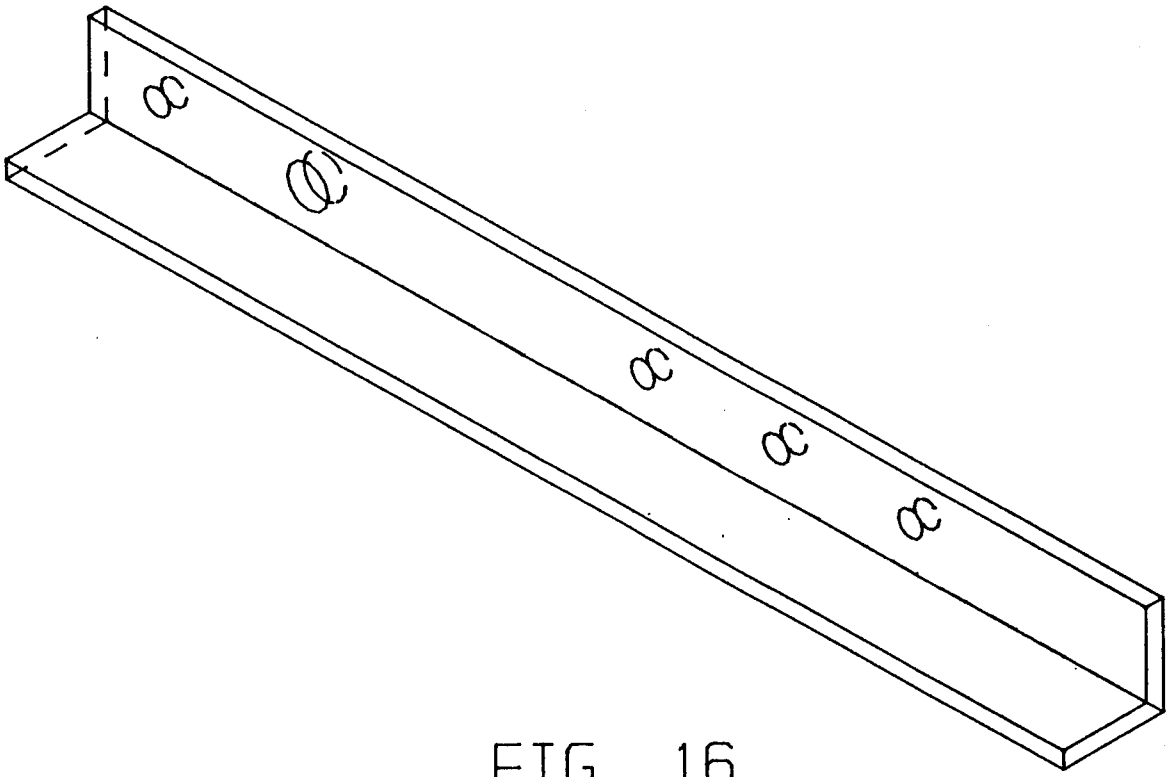
FIG. 16 is a side view of an upper, longer angle.
Figure 17:
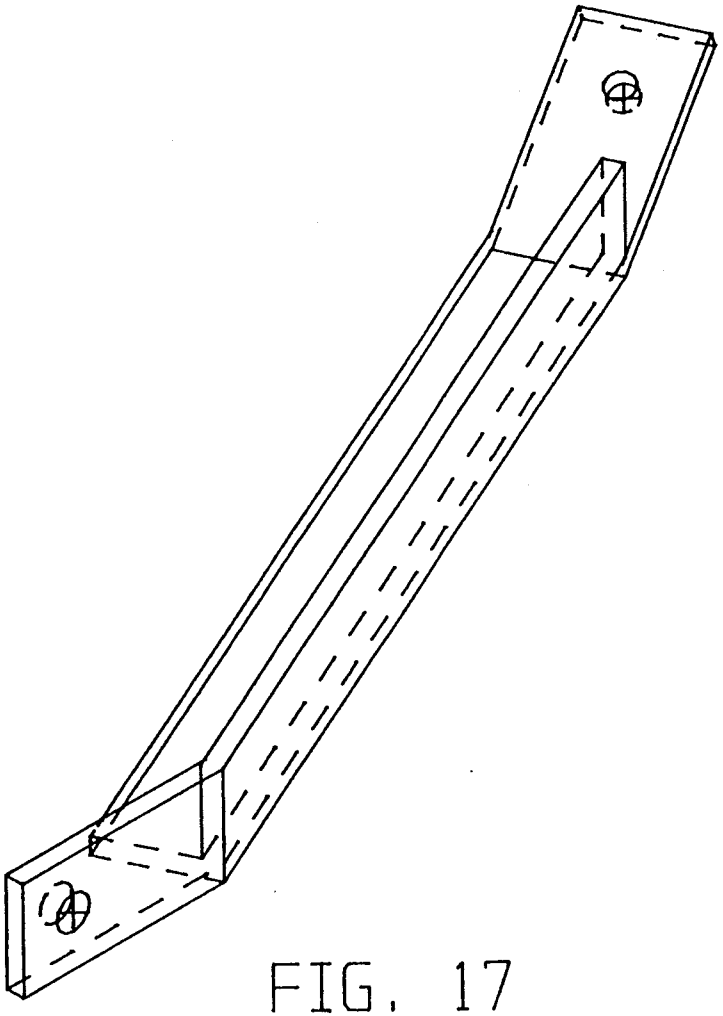
FIG. 17 is a top view of the left angle used as a brace and stabilizer for the horizontal stationary bar. Note the angle has been modified by removing approximately two inches of the upper, right side and approximately two inches of the lower left side and the altered portions of the angle have been bent for more compact placement.
Figure 18:
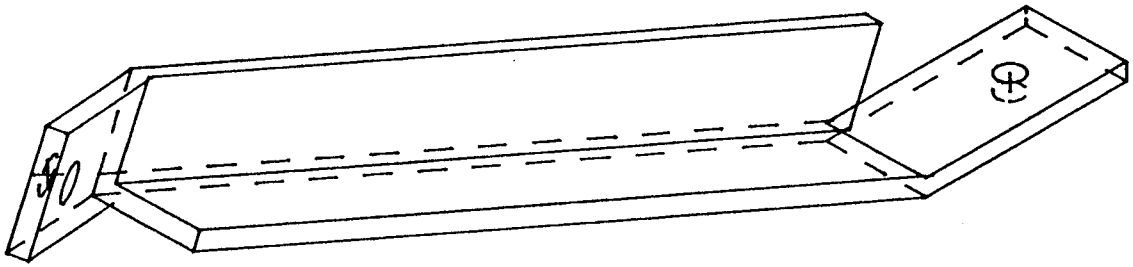
FIG. 18 is a inside angle view of the right angle which is used as a brace and stabilizer for the horizontal stationary cross bar. Note the angle has been modified by removing approximately two inches of the upper, right side and approximately two inches of the lower left side and the altered portions of the angle being bent for more compact placement.
Figure 19:
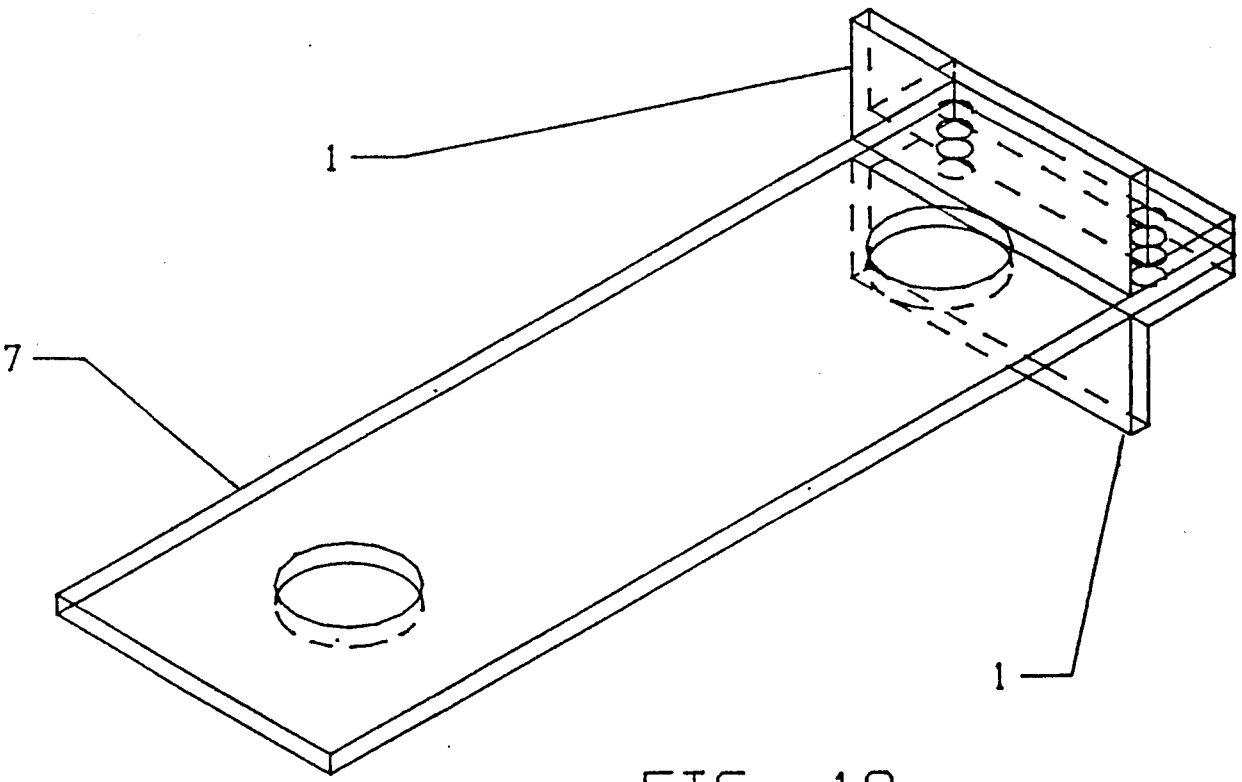
FIG. 19 is a top view of an alignment spacer bar assembly.

Referring now to FIG. 19, the horizontal tube alignment bar 7 has two large circular holes bored at the mid point approximately ½ inch from either end of the bar. The hole to the left is designated the front hole and when assembled in the device allows the horizontal tubing 6 of the front non stationary cross bar [see FIG. 22] to pass freely with none of its movement restricted. The hole on the right is designated the back hole and through it passes the horizontal tubing 6 of the back stationary cross bar [See FIG. 21] which is held rigidly to the alignment bar 7 by means of two simple angles 1 which are secured by attachment means to both bar 7 and the horizontal tubing FIG. 21-6. The horizontal tube alignment bar 7 with the two simple angles 1 attached combine to make the alignment bar assembly 19.

Figure 20:
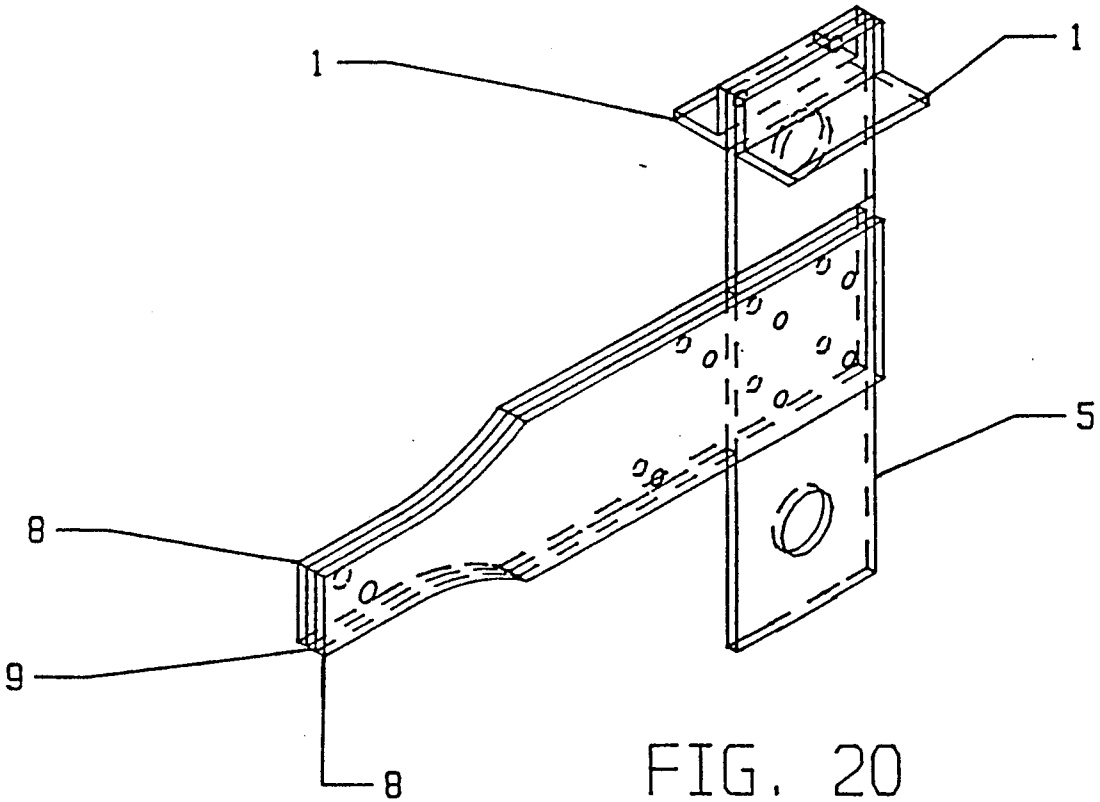
FIG. 20 is a side view of the center support assembly.
Figure 21:
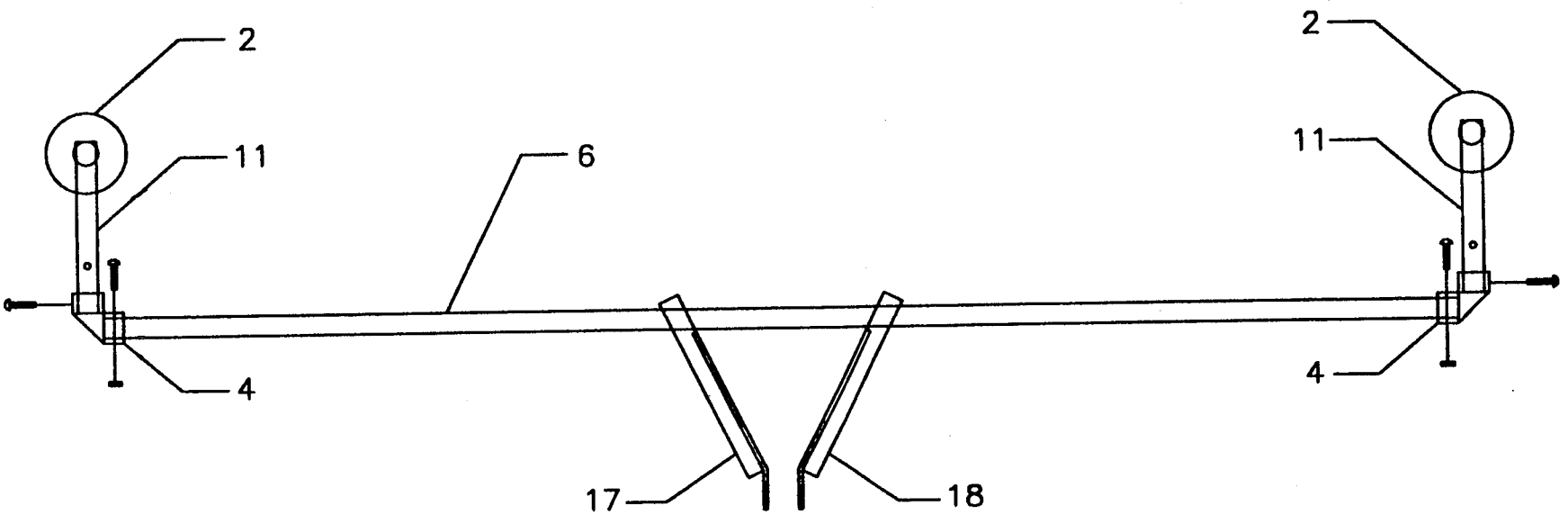
FIG. 21 is a front view of the stationary horizontal cross bar.
Figure 22:
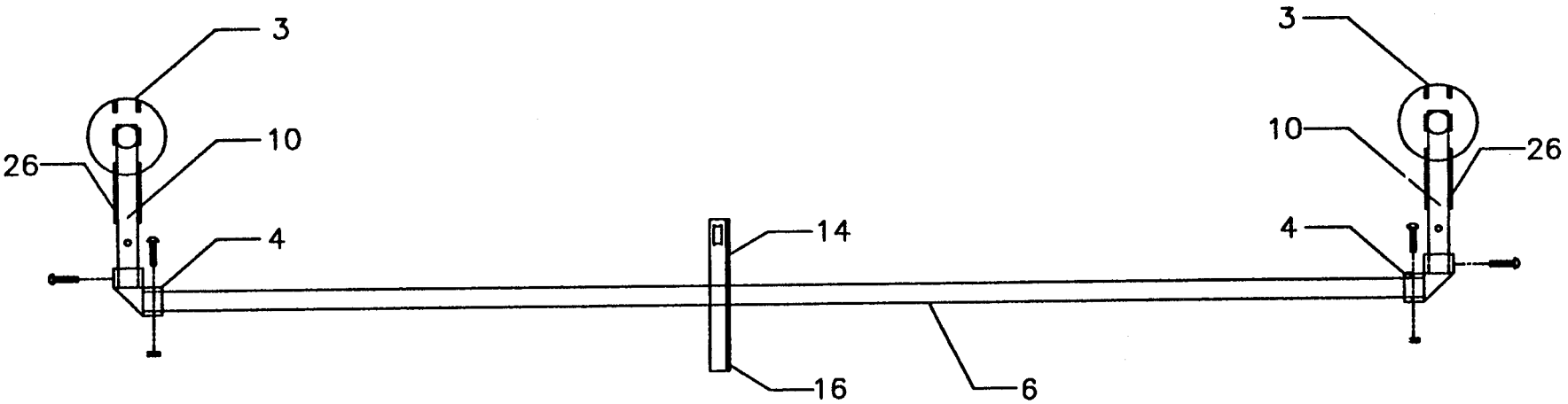
FIG. 22 is a front view of the non stationary horizontal cross bar.

Now referring to FIG. 20 which is a side angular view of the center support assembly, the lower large hole on the center spacer bar 5 allows the horizontal tubing 6 of the front non stationary cross bar [See FIG. 22] to pass freely with no restrictions to its movement. The back stationary cross bar [See FIG. 21] passes through the large hole in the upper portion of the spacer bar 5 and is held rigidly by two simple angles 1 affixed by attachment means to both the center space bar 5 and the horizontal tubing 6 of the back stationery cross bar 21. The center spacer bar 5 is sandwiched between the upper portion of two main outer vertical center supports 8 while the main inner vertical center support 9 is sandwiched between the lower portion to form a T-shaped center support which along with the two braces 1 make the center support assembly 20. This assembly not only supports, separates, and aligns the horizontal tubing 6 of both horizontal cross bars [FIGS. 21 and 22] but also is used to secure the device to the pole.

Referring now to FIG. 21, a front view of the back stationary horizontal cross bar which utilizes a pair of rubber like, firm but flexible cups 2 which happen to be suction cups. These cups were used because of their ability to gently and safely grip and hold a fluorescent tube. The fluorescent tube is not held in the tube by suction. The cups 2 are affixed to short vertical arms or tubes 11 which have been pressed flat at their upper ends. This was necessary to minimize the width of the part of the device which must be inserted between the fluorescent tubes in a lighting fixture. The lower end of the vertical tube or arm 11 is connected by means of a 90 degree elbow to a horizontal cross tubing 6 having a longitudinal length sufficient to support a fluorescent tube. A left angle 17 and a right angle 18 are used to brace the u-shaped elongated back cross bar in rigid position. The left angle 17 has been modified at its upper end by removing approximately 2" of the right side of the angle and shaping the remaining side to fit the horizontal tubing 6. On the lower end of the left angle 17 approximately 2" of the left side has been cut away and the remaining right side bent to fit flush against the center support assembly. The right angle 18 has been modified at its upper end by cutting away approximately 2" on the left side of the angle and shaping the remaining side to fit the horizontal cross tubing 6. On the lower end of the right angle 18 approximately 2" of the right side has been cut away and the remaining left side bent to fit flush against their center support assembly 20.

Now referring to FIG. 22 the front horizontal non stationary cross bar, two rubber like, firm but flexible cups 3 are attached at the top extremities of the two vertical tubes or arms 10 whose lower ends are connected by means of a 90 degree elbows to horizontal cross tubing 6 whose longitudinal length may vary but is always of equal length to the horizontal cross tubing 6 in the front cross bar 21. The cups are held in a curved position by means of a shaper plate 27 which is affixed to the vertical arm 10. The curved nature as well as the opposing positions allow the cups to firmly yet safely hold the fluorescent tube. At midpoint of the horizontal tubing 6 is the upper pulley 12, the upper, larger angle or arm 16 upon which the pulley is mounted, and the clamp 14 which secures the arm 16 to the horizontal cross tubing 6. This arm 16 controls the back and forth movement of the front horizontal cross bar 22.

Figure 23:
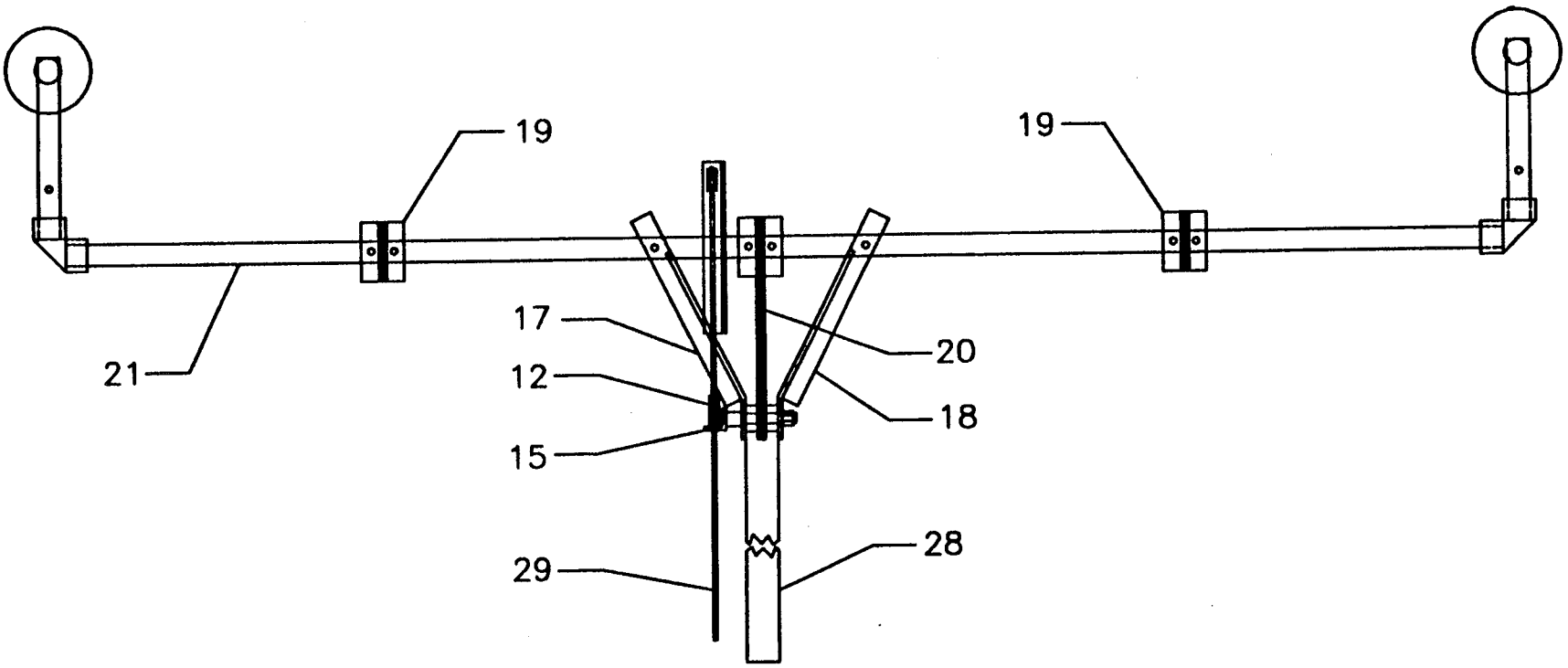
FIG. 23 is the front view of the main assembly of the device.

Now referring to FIG. 23 which is a rear view of the device and shows the placement of the two horizontal tube alignment bars 19, each being located oppositely approximately midway between the center of the horizontal cross tubing 6 and its extremity. This figure also shows placement of the center support assembly 20, the lower pulley 12, the rope 29, and the pole 28.

Figure 24:
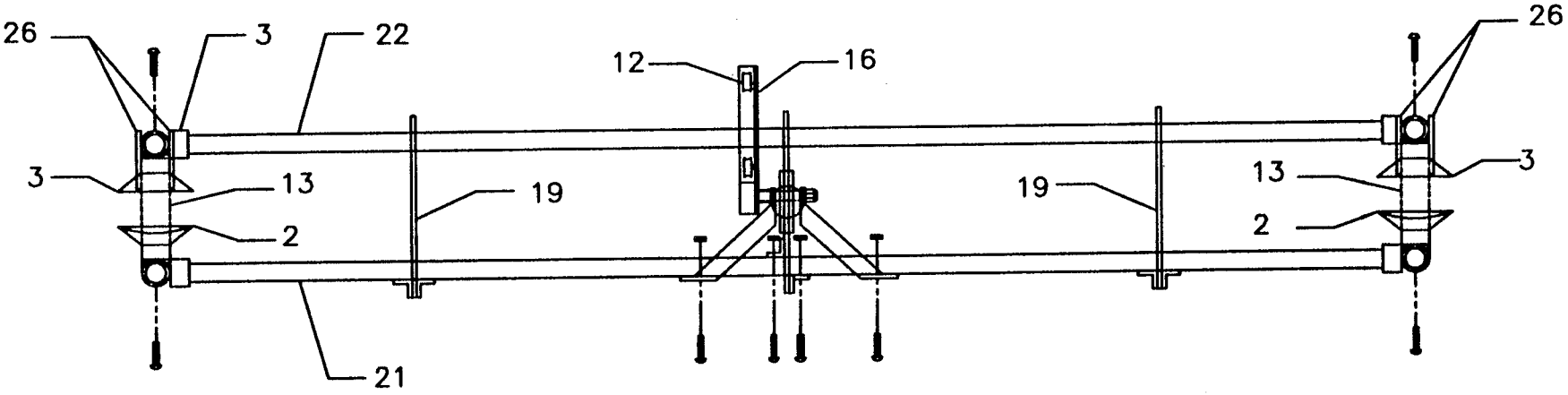
FIG. 24 is the top view of the main assembly of the device.

Now referring to FIG. 24 which is the top view of the device with the upper elongated horizontal cross bar 22 being the front of the device. This figure illustrates the relationship of the two horizontal cross bars-front non stationary 22 and back stationary 21, and how they are affected by a pair of springs 13, which are located below each pair of cups 2 and 3. The relationship of the front cross bar 22 and the back cross bar 21 is regulated by these two springs. Their action is very important and unique to the operation of this device. Their function will be understood more clearly when viewing FIG. 25. The placement of the two alignment bar assemblies 19 not only maintains the alignment of the two cross bars 21 and 22 but also aid the stability of the device which is vital when replacing fluorescent tubes at maximum heights.

Figure 25:
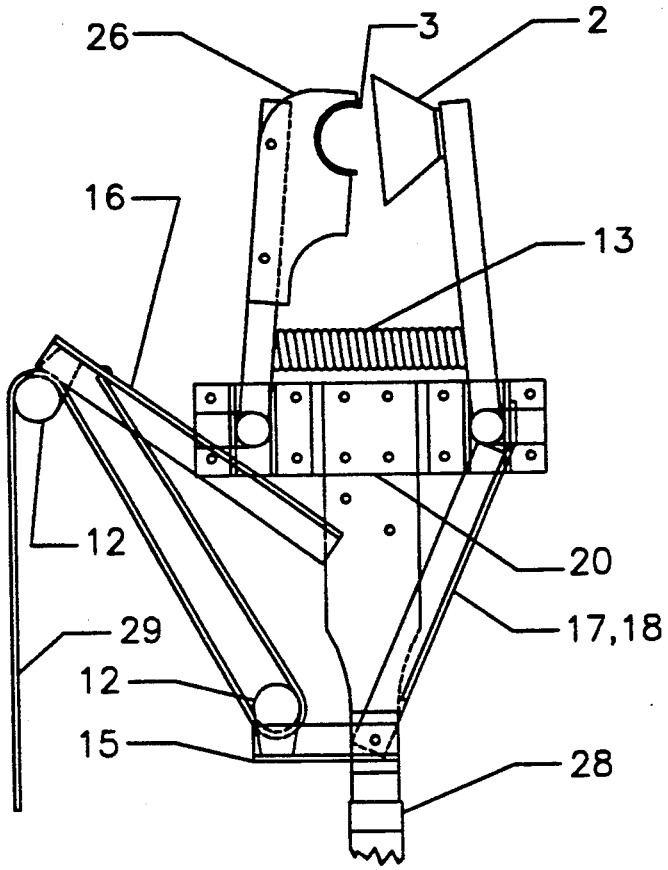
FIG. 25 is a side view of the main assembly of the device.
Figure 26:
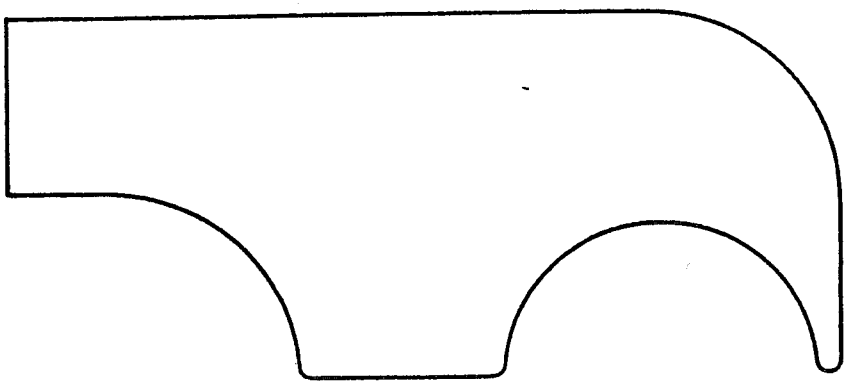
FIG. 26 is a side view of the shaper plate.

Now referring to FIG. 25, a side view which more clearly illustrates how the various components parts interact. The rope 26 goes through the upper pulley 12 down to the lower pulley 12 which is affixed to the lower, shorter angle or arm 15 which in turn in secured to the center support assembly 20, then the rope goes back up to be attached to the upper, longer angle 16 which moves the front horizontal non stationary cross bar forward, extends the springs 13 and allows the cups to separate thereby either releasing or accepting a fluorescent tube. Since this device will be used at some distance above the operator's head, it is important to minimize the effort needed to be exerted by the operator and this is done by the leverage created when the rope passes through the pulleys. The importance of having the spring in a no tension position while the fluorescent tube is held by the device means that both of the operator's hands are free for maneuvering the device to either remove or replace a fluorescent tube in a lighting fixture. One of the two springs 13 is secured by attachment means to the vertical arm 10 [See FIG. 22] and the other spring 13 is secured by attachment means to vertical arm 11 [See FIG. 21], both being immediately above the elbows. These springs are partially covered by clear plastic tubing which protects the fluorescent tube should it slip and strike the springs while being handled.

Next the mode of operation for removing a fluorescent tube will be described. The operator raises the device to a position immediately below the lighting fixture. Then he holds the pole 28 with one hand and braced the end of the pole 28 against his mid-body. The operator's other hand holds the rope 26 to assist in stabilizing the device while centering and positioning the rubber like cups 2 and 3 under the fluorescent tubes to be removed. A pull on the rope 26 will cause the springs 13 to extend and allow the non stationary horizontal cross bar 22 to move and open the cups. The operator then raises the device until the cups enclose the fluorescent tube. After making sure the cups are positioned around the tube, he releases the pressure on the rope and the cups firmly grip the tube. The operator then rotates the fluorescent tube with the device to break the oxidation on the pins. With both hands on the pole he pushes the device toward the end of the fixture which contains the pressure spring that releases the fluorescent tube. Once the fluorescent tube is free of the fixture, the operator lowers the device holding the fluorescent tube to the floor, pulls on the rope to separate the cups and release the fluorescent tube.

In order to install a fluorescent tube, the above described steps for removing a fluorescent tube are reversed. That is, a new fluorescent tube is gripped between the rubber like cups by pulling the rope to open the cups, inserting the tube, then releasing pressure on the rope. The operator then lifts the device to position immediately below the fixture. Using both hands the operator can insert the fluorescent tube pin with the spring into the fixture slot, apply pressure to recoil the spring and then insert the other pin at the opposite end into the fixture slot. Once the fluorescent tube is in place, a pull on the rope 26 will cause the non stationary cross bar 22 to move, separating the cups 2 and 3 and releasing the fluorescent tube.

When this invention is used as described above, an old fluorescent tube can be replaced with a new fluorescent tube in a simple and easy manner. Furthermore it becomes possible to remove a fluorescent tube from a high position or install a fluorescent tube at a high position in a simple yet reliable manner.

When the pole or handle is made of metal alloy, a wooden section is inserted into the pole to prevent an electrical charge from passing to the operator should the device come into contact with live current. It is also advised that the operator of this device wear safety glasses or goggles to protect his eyes in the event the tube should be broken and slivers of glass fall on the operator.

What I claim is:

1. A device for installing and removing single pin fluorescent tubes form a lighting fixture comprising:

a set of equal length, elongated U-shaped horizontal cross bars, one of said cross bars being stationary and the other being non-stationary, each of said cross bars further comprising a predetermined length horizontal cross tube with a 90° elbow at each end and a predetermined length vertical tube attached to each elbow;

flexible cups attached to each to outer ends of each vertical tube, a pair of plates attached to each vertical tube on said stationary bar, said plates having a curved surface that conforms to the shape of the respectively attached cups to hold the cups in a rigid, curved position, the cups on the stationary bar facing those on the non-stationary bar, thus forming a fixture gripping area there between;

a first spring secured to one of the vertical tubes on the stationary bar and to the opposite vertical tube on the non-stationary bar, a second spring secured in like manner between the other two vertical tubes, said springs urging the non-stationary bar toward the stationary bar;

a support bracket rigidly mounting said stationary bar at one end and pivotally mounting said non-stationary bar at the other end, a handle support extending from and attached to said support bracket for attachment of a standard bar handle, a lower pulley support attached to said handle support and a lower pulley attached to said lower pulley support, an upper pulley support rigidly attached to said non-stationary bar adjacent to said support bracket and an upper pulley attached to said upper pulley support, a rope fixed at one end to said upper pulley support and movably mounted about said upper and lower pulleys, thus a user pulling on said rope will cause pivoting of said upper pulley support and said non-stationary bar to move the attached cups away from those on said stationary bar;

whereby a user pulls on said rope to pivot said cups attached to said non-stationary bar away from those on said stationary bar then moves the device into position around a fluorescent tube, said springs will then move said cups on said non-stationary bar toward said stationary bar to grip the fluorescent tube to either remove or install the tube.

2. A device according to claim 1 further comprising alignment spacer bars attached to both the stationary and non-stationary bars to hold the bars in a parallel relationship with respect to each other.

* * * * *